US010845734B2

(12) United States Patent
Sabo et al.

(10) Patent No.: US 10,845,734 B2
(45) Date of Patent: Nov. 24, 2020

(54) WIPER ASSEMBLIES

(71) Applicant: HP Indigo B.V., Amstelveen (NL)

(72) Inventors: David Sabo, San Diego, CA (US); John W. Godden, San Diego, CA (US)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/472,994

(22) PCT Filed: Feb. 27, 2017

(86) PCT No.: PCT/US2017/019739
§ 371 (c)(1),
(2) Date: Jun. 24, 2019

(87) PCT Pub. No.: WO2018/156168
PCT Pub. Date: Aug. 30, 2018

(65) Prior Publication Data

US 2020/0089145 A1 Mar. 19, 2020

(51) Int. Cl.
*G03G 15/11* (2006.01)

(52) U.S. Cl.
CPC ..... *G03G 15/11* (2013.01)

(58) Field of Classification Search
CPC ..... G03G 15/11; G03G 15/0225
See application file for complete search history.

(56) References Cited

U.S. PATENT DOCUMENTS

| | | | |
|---|---|---|---|
| 5,757,399 | A | 5/1998 | Murayama et al. |
| 6,164,751 | A | 12/2000 | Griffin et al. |
| 6,527,362 | B2 | 3/2003 | Hood et al. |
| 6,896,353 | B2 | 5/2005 | Tee et al. |
| 7,668,488 | B2 | 2/2010 | Guzman et al. |
| 8,695,502 | B2 | 4/2014 | Peles et al. |

FOREIGN PATENT DOCUMENTS

| | | |
|---|---|---|
| CN | 102448726 | 5/2012 |
| CN | 102812403 | 12/2012 |
| CN | 104204962 | 12/2014 |
| WO | WO-2010138129 | 12/2010 |
| WO | WO-2012030330 | 3/2012 |
| WO | WO-2017030580 A1 | 2/2017 |

*Primary Examiner* — Arlene Heredia
(74) *Attorney, Agent, or Firm* — Dicke Billig & Czaja PLLC

(57) ABSTRACT

A print agent application assembly is disclosed. The print agent application assembly may include a first roller to remove print agent from a surface of a print agent transfer roller. The print agent application assembly may include a second roller having an absorbent element to engage the first roller as the second roller rotates relative to the first roller, the absorbent element to absorb print agent from the first roller. The print agent application assembly may include a wiper assembly. The wiper assembly may include a wiper element to scrape print agent from the surface of the first roller as the first roller rotates, and an engagement element to engage with and compress a portion of the absorbent element of the second roller as the second roller rotates relative to the wiper assembly. A method and a roller cleaning assembly are also disclosed.

13 Claims, 4 Drawing Sheets

WIPER ASSEMBLIES

BACKGROUND

In the field of printing, liquid electrophotography (LEP) technology may be implemented. LEP printing involves the transfer of electrically-charged liquid ink via a series of rollers to a substrate.

BRIEF DESCRIPTION OF DRAWINGS

Examples will now be described, by way of non-limiting example, with reference to the accompanying drawings, in which.

DETAILED DESCRIPTION

In a liquid electrophotography (LEP) printing system, print agent, such as ink, is stored in a print agent application assembly, such as a binary ink developer (BID). Each BID stores print agent of a particular colour, so an LEP printing system may include, for example, seven BIDs. Print agent from a BID is selectively transferred from a developer roller of the BID in a layer of substantially uniform thickness to a photo imaging plate (PIP). The selective transfer of print agent is achieved through the use of electrically-charged print agent. The entire PIP is charged, then areas representing an image to be printed are discharged. Print agent is transferred to those portions of the PIP that have been discharged. The PIP transfers the print agent to a printing blanket, which subsequently transfers the print agent onto a printable substrate, such as paper. The discharged portions of the PIP represent the portion or portions of a pattern or image in which print agent from the BID is to be applied to the substrate. Print agent that is not transferred from the developer roller to the PIP (i.e. in those areas where the PIP remains charged) remains on the developer roller of the BID, and is removed from the developer roller by components within the BID, as discussed below.

Figure 1:
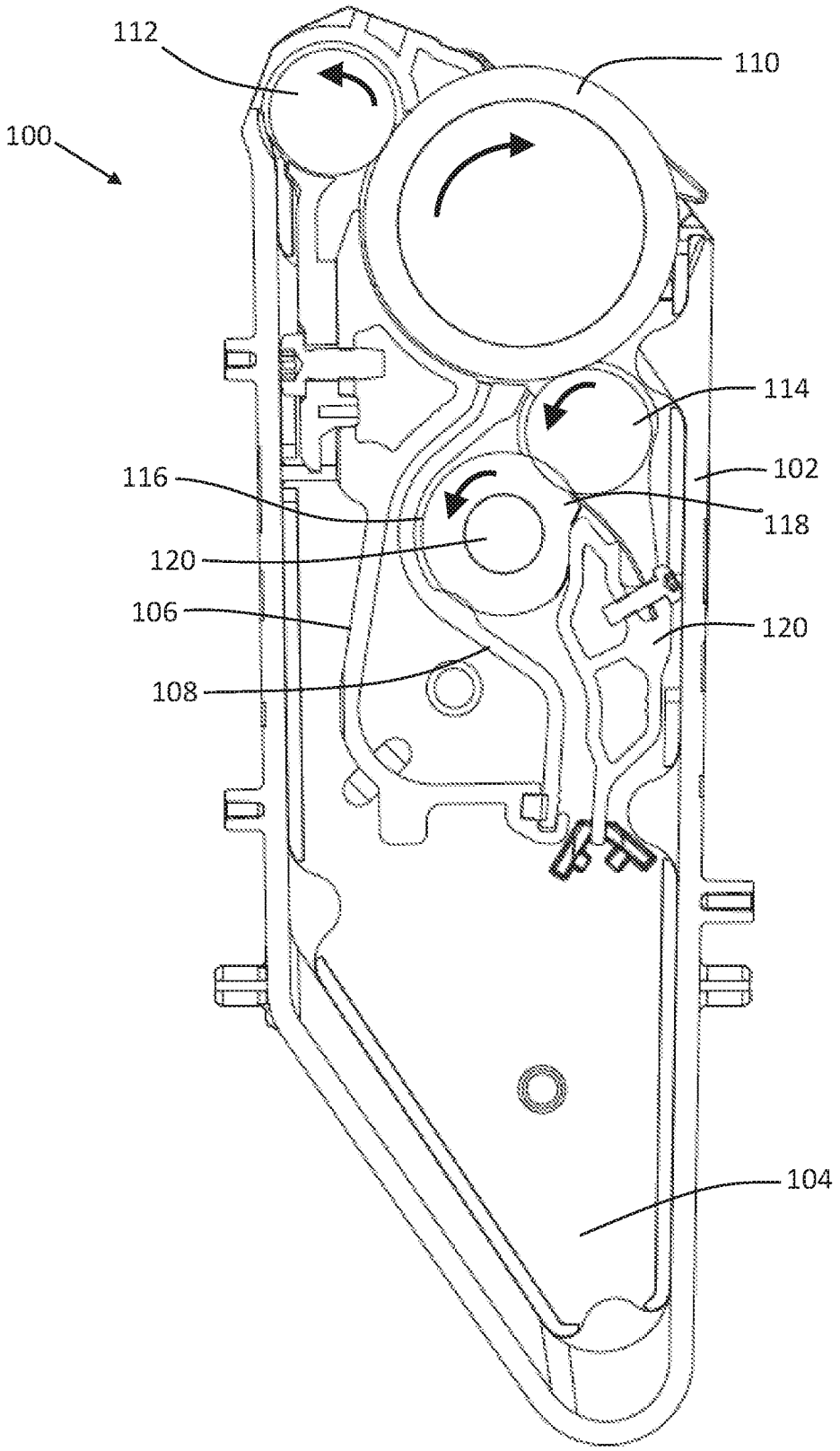
FIG. 1 is a sectional representation of an example of a print agent application assembly.

FIG. 1 is a sectional representation of a print agent application assembly 100. Some components of the print agent application assembly 100 are not shown in FIG. 1 for clarity.

The print agent application assembly 100 includes a housing 102 within which other components are at least substantially disposed. An ink tray 104, is formed near to the bottom of the housing 102, to catch unused print agent, as discussed below. The ink tray 104 may be referred to as an ink capture tray. The assembly 100 includes a first electrode 106 and a second electrode 108. Print agent may travel from a print agent reservoir (not shown), which may be located outside the print agent application assembly 100, between the first and second electrodes 106, 108, towards a developer roller 110. The developer roller 110 rotates in a direction shown in FIG. 1.

The assembly 100 further includes a squeegee roller 112, which rotates in a direction opposite to the direction of rotation of the developer roller 110, as shown in FIG. 1. The squeegee roller 112 is urged towards the developer roller 110 so as to compact and remove excess liquid from the print agent that coats the developer roller. The squeegee roller causes the print agent on the developer roller to be of substantially uniform thickness. After being compacted by the squeegee roller 112, print agent on the developer roller 110 is selectively transferred to a selectively charged photo imaging plate (not shown) and, subsequently, to a printing blanket for transfer onto a substrate, as described above.

Print agent that is not transferred from the developer roller 110 to the photo imaging plate is referred to as unused print agent. A cleaner roller 114 is disposed within the assembly 100 adjacent to the developer roller 110, and rotates in a direction opposite to the direction of rotation of the developer roller 110, as shown in FIG. 1. The cleaner roller 114 is electrically charged and attracts electrically-charged print agent, thereby cleaning unused print agent from the developer roller 110.

The assembly 110 also includes a sponge roller 116, which includes an absorbent material 118, such as a sponge, mounted around a core 120. The sponge roller 116 rotates in the same direction as the cleaner roller, as shown in FIG. 1. The sponge roller 116 is mounted adjacent to the cleaner roller, such that, as the sponge roller rotates, the absorbent material 118 absorbs the unused print agent from the surface of the cleaner roller. The absorbent material 118 of the sponge roller has a number of open cells, or pores, for absorbing liquid, such as the unused print agent. In some examples, the absorbent material 118 may be open-cell polyurethane foam.

A wiper assembly 120 is also mounted within the assembly 100, and its components and function are discussed with reference to FIG. 2.

Figure 2:
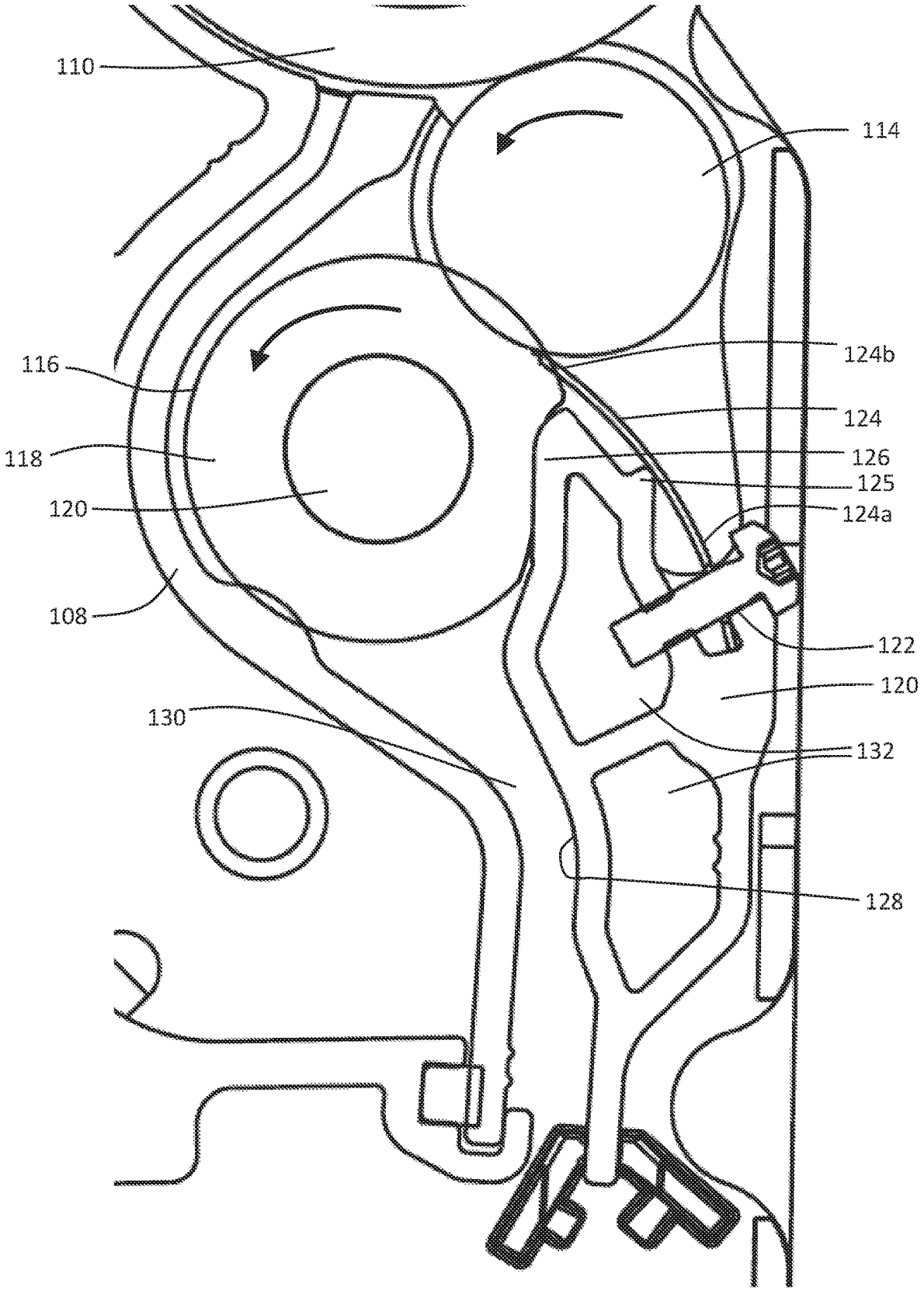
FIG. 2 is a sectional representation of a portion of the print agent application assembly shown in FIG. 1.

FIG. 2 is an enlarged view of a portion of the print agent application assembly 100 shown in FIG. 1. The wiper assembly 120 (or components thereof) may serve to wipe, or clean, portions of one or more of the rollers in the assembly 100. As such, the wiper assembly 120 may be referred to as a roller cleaning assembly. The wiper assembly 120 may include an attachment assembly, or mounting assembly, 122 for attaching a wiper blade 124 to the wiper assembly. The wiper blade 124 has a proximal end 124*a* at which it is attached to the wiper assembly 120, and a distal end 124*b* which engages the surface of the cleaner roller 114. The wiper blade 124 may serve to wipe unused print agent from the cleaner roller 114 onto the sponge roller 116. In this way, the cleaner roller 114 may be cleaned by a combination of the wiper blade 124 and the sponge roller 116; the sponge roller may remove the more liquid print agent and the wiper blade may remove the more solid print agent. The wiper blade 124 may be referred to as a doctor blade.

In some examples, such as the example shown in FIG. 2, the attachment assembly 122 may comprise a screw or a bolt threaded through the wiper blade 124 (for example at its proximal end 124*a*) and through the wiper assembly 120. In other examples, alternative attachment mechanisms may be employed.

The wiper assembly 120 may further comprise a wiper blade support 125. The wiper blade support 125 may comprise a protrusion or bump extending from the wiper assembly 120. The wiper blade support 125 serves to support the wiper blade in a desired location relative to the cleaner roller 114. While one wiper blade support 125 is shown in FIG. 2, the wiper assembly 120 may, in some examples, include multiple supports. For example, supports 125 may be space along the length of the wiper blade 124, from the proximal end 124*a* to the distal end 124*b*.

The wiper assembly 120 may, in some examples, further include an engagement element, or roller engagement element, 126 which engages the sponge roller 116 as the sponge roller rotates. The engagement element 126 may engage and compress a portion of the absorbent material 118 of the sponge roller 116 as the sponge roller rotates. In this way, the engagement element 126 may be considered to squeeze, or wring out, the sponge roller 116. The act of compressing the absorbent material 118 of the sponge roller 116 may serve to release the unused print agent that has been absorbed by the absorbent material from the cleaner roller 114. After a portion of the absorbent material 118 has been compressed by the engagement 126, the absorbent material expands to assume its original (i.e. uncompressed) shape.

The wiper assembly 120 may further include a wall 128. In some examples, the wall 128, along with the first electrode 108, may define a passageway or channel 130 through which unused print agent squeezed from the sponge roller 116 may pass. Unused print agent that is released from the sponge roller 116 may gravitate downwards through the channel 130 into the ink capture tray 104 (see FIG. 1) from which the unused print agent may drain into the print agent reservoir to mix with other print agent to be used again.

In some examples, the wiper assembly 120 may include a cavity, a cut-out, or a cutaway portion, such as cutaway portions 132. The cutaway portions 132 may extend along the length of the wiper assembly 120. In some examples, the length of the wiper assembly may correspond with the length of the sponge roller 116 and/or the cleaner roller 114. The cutaway portions 132 may serve to reduce the weight of the wiper assembly 120 and, therefore, the weight of the print agent application assembly 100. The cutaway portions 132 may have a shape selected to minimise the weight of the wiper assembly 120, without jeopardising the strength and/or structural integrity of the wiper assembly.

The wiper assembly 120 may, in some examples, be formed from a single piece of material. In some examples, the wiper assembly 120 may be formed from aluminium. In other examples, the wiper assembly may be formed from plastics material, such as thermoplastics. Various methods may be employed to form the wiper assembly, such as extrusion, or injection moulding, for example. By forming the wiper assembly as a single component, from a single material, manufacturing time and costs may be kept to a minimum. Furthermore, by forming the engagement element 126 as part of the wiper assembly 120, rather than as a separate component, such as a separate squeezer roller, the manufacture, installation and maintenance of the wiper assembly, and of the print agent application assembly 100, may be simplified. A separate roller to squeeze the sponge roller may have a complicated mounting structure, and may include bearings which are likely to be more difficult to install, and have a greater potential to malfunction.

Figure 3:
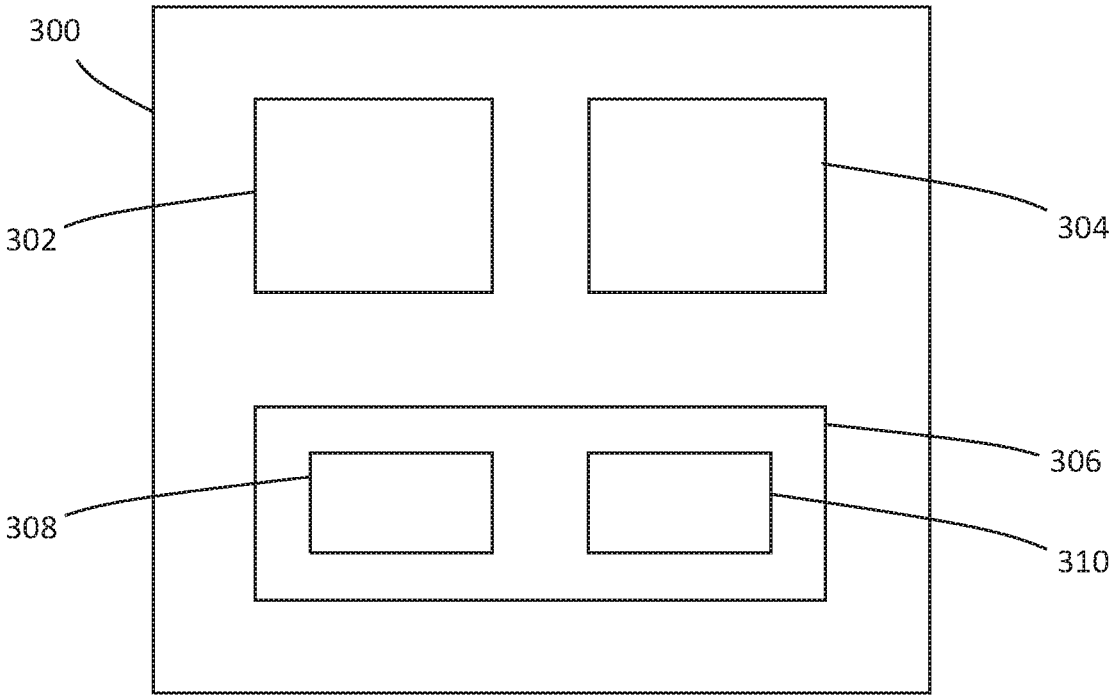
FIG. 3 is a schematic illustration of an example of a print agent application assembly.

FIG. 3 is a schematic illustration of an example of a print agent application assembly 300, such as a binary ink developer (BID), which may be similar to the assembly 100 discussed above. The print agent application assembly 300 may comprise a first roller 302. The first roller 302 may be operable to remove print agent from a surface of a print agent transfer roller. In some examples, the first roller 302 may comprise or be similar to the cleaner roller 114 discussed above. The print agent transfer roller may be a developer roller, such as the developer roller 110 discussed above. The assembly 300 may comprise a second roller 304 having an absorbent element. The absorbent element may be operable to engage the first roller 302 as the second roller rotates relative to the first roller. The absorbent element may absorb print agent from the first roller 302. The second roller 304 may comprise or be similar to the sponge roller 116 discussed above, and the absorbent element may comprise or be similar to the absorbent material 118. The assembly 300 may comprise a wiper assembly 306, such as the wiper assembly 120 discussed above. The wiper assembly 306 may comprise a wiper element 308. The wiper element 308 may be operable to scrape print agent from the surface of the first roller 114 as the first roller rotates. The wiper assembly 306 may comprise an engagement element 310. The engagement element 310 may be operable to engage with and compress a portion of the absorbent element of the second roller 304 as the second roller rotates relative to the wiper assembly. The wiper element 308 may comprise or be similar to the wiper blade 124 discussed above, and the engagement element 310 may comprise or be similar to the engagement element 126 discussed above.

In some examples, the wiper element 308 may be mounted to the wiper assembly 306 by a mounting assembly or an attachment assembly, such as the attachment assembly 122 discussed above. The attachment assembly may include a screw or a bolt, and may serve to secure the wiper element 308 in such a position that it engages the first roller 302.

The engagement element 310 of the wiper assembly 306 may, in some examples, comprise a protrusion extending from the wiper assembly. In other examples, the engagement element 310 may comprise a lip, a bump or a series of bumps, capable of compressing the absorbent element of the second roller 304.

The wiper assembly 306 may have a length corresponding to a length of the absorbent element of the second roller 304. The absorbent element may extend substantially along the length of the second roller 304. In some examples, the second roller 304 and the first roller 302 may have similar lengths. The wiper assembly 306 may, in some examples, include a cutaway portion along the length of the wiper assembly. The cutaway portion may, for example, be similar to the cutaway portions 132 discussed above.

As noted above, the first roller 302 may comprises a cleaner roller. A portion of the cleaner roller may be electrically-charged so as to attract electrically-charged print agent from the print agent transfer roller.

In some examples, the wiper assembly 306 may include a wall, such as the wall 128 discussed above. The wall may form one wall of a channel through which print agent is to flow from the second roller 304 to a print agent capture tray. The print agent may then drain from the capture tray into a print agent reservoir for reuse. In some examples, the channel may be defined by the wall of the wiper assembly and an electrode (not shown in FIG. 3) of the print agent application assembly 300.

Figure 4:
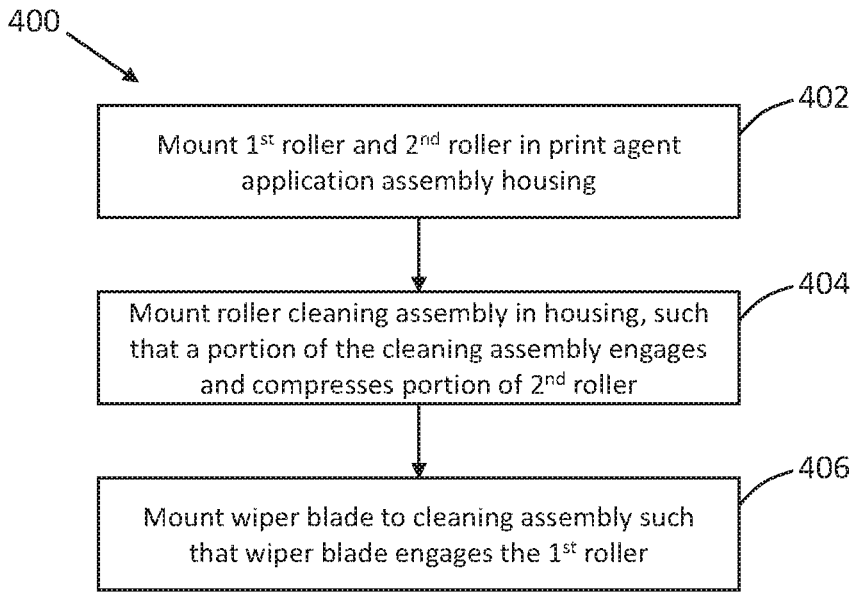
FIG. 4 is a flowchart of an example of a method of assembling a print agent application assembly.

Referring now to FIG. 4, a method 400 is disclosed. FIG. 4 is a flowchart of an example of a method of assembling a print agent application assembly, such as the assemblies 100 and 300 discussed above.

The method 400 may comprise, at block 402, mounting a first roller 114, 302 and a second roller 116, 304 in a print agent application assembly housing 102. At block 404, the method 400 may further comprise mounting a roller cleaning assembly 120, 306 in the print agent application assembly housing 102, such that a portion 126, 310 of the cleaning assembly engages and compresses a portion of the second roller 116, 304. The method may further comprise, at block 406, mounting a wiper blade 124, 308 to the roller cleaning assembly 120, 306 such that the wiper blade engages the first roller 114, 302, thereby to wipe print agent from the first roller as it rotates relative to the wiper blade.

Figure 5:
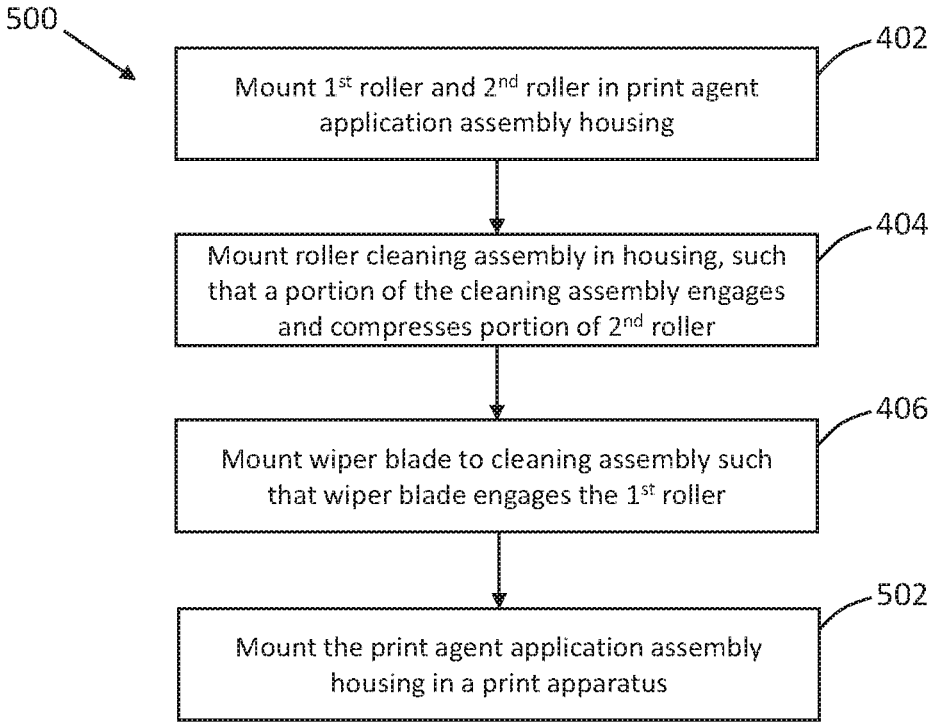
FIG. 5 is a flowchart of a further example of a method of assembling a print agent application assembly.

A further method 500 is shown in FIG. 5. FIG. 5 is a flowchart of a further example of a method of assembling a print agent application assembly. The method 500 comprises the blocks 402, 404 and 406 of FIG. 4, and may further comprise, at block 502, mounting the print agent application assembly housing 102 in a print apparatus. In some examples, the print apparatus may comprise a liquid electrophotography (LEP) print apparatus.

In some examples, the roller cleaning assembly 120, 306 may comprise a single extruded element. Forming the roller cleaning assembly in this way may reduce the manufacturing time and cost.

The portion 126, 310 of the cleaning assembly that engages and compresses a portion of the second roller 116, 304 may, in some examples, comprise a protrusion extending from, or a corner portion of, the roller cleaning assembly 120, 306. In some examples, the portion 126, 310 may comprise a lip, a bump or a series of bumps capable of compressing the portion of the second roller. The amount by which the absorbent part 118 of the second roller 304 (e.g. the sponge roller 116) may be compressed by the engagement portion 126, 310 of the roller cleaning assembly 120, 306 may depend on the position of the engagement portion relative to the absorbent part. In some examples, however, the roller cleaning assembly 120, 306 may be mounted such that the portion of the second roller 116, 304 is compressed by between around 0.5 millimetres and around 3 millimetres. In some examples, the compression may be between around 0.75 millimetres and 3 millimetres. In some examples, the compression is between around 2 millimetres and 2.5 millimetres. In other words, the radius of the second roller 116, 304 is reduced (temporarily) by between around 0.5 millimetres and around 3 millimetres (or between around 0.75 millimetres and 3 millimetres, or between around 2 millimetres and 2.5 millimetres) at the region where the second roller engages the engagement portion of the roller cleaning assembly 120, 306.

Figure 6:
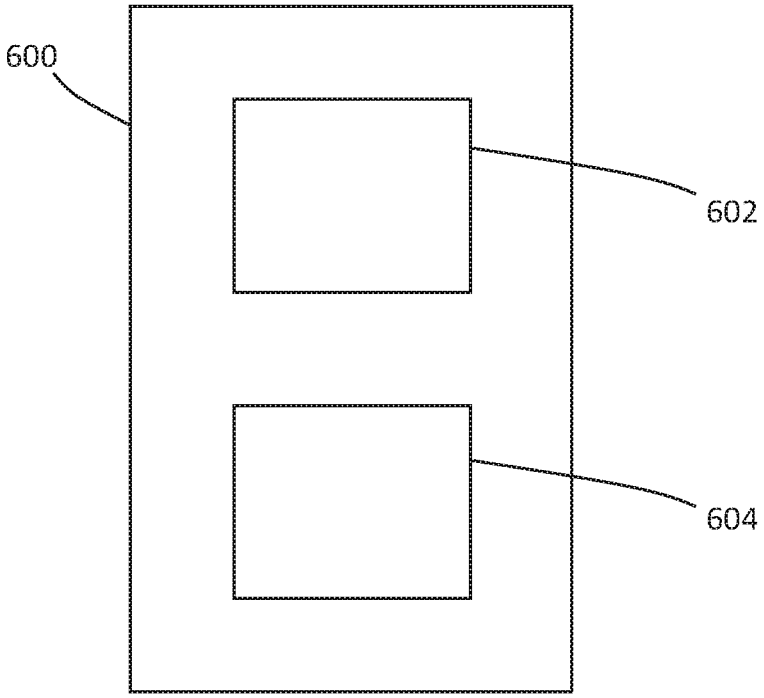
FIG. 6 is a schematic illustration of an example of a roller cleaning assembly.

FIG. 6 is a schematic illustration of an example of a roller cleaning assembly 600. The roller cleaning assembly 600 may comprise or be similar to the wiper assembly 120 of FIGS. 1 and 2, and/or the roller cleaning assembly 306 of FIG. 3. The roller cleaning assembly 600 may comprise a scraper mounting assembly 602. The scraper mounting assembly 602 may be operable to enable a scraper to be mounted to the roller cleaning assembly in such a way that the scraper can scrape print agent from a surface of a first roller 114, 302. The scraper (not shown in FIG. 6) may comprise or be similar to the wiper blade 124 and/or the wiper element 308, and may include any component suitable for wiping or scraping print agent from a roller. The roller cleaning assembly 600 may comprise a roller engagement portion 604. The roller engagement portion 604 may be operable to engage and compress a portion of a second roller 116, 304 as the second roller rotates relative to the roller cleaning assembly 600.

In some examples, the portion of the second roller 116, 304 that may be engaged and compressed comprises an absorbent element, such as the absorbent element 118 of the sponge roller 116. The roller engagement portion 604 may be operable to compress the portion of the second roller by between around 1 millimetre and around 3 millimetres. In some examples, the desired compression of the second roller may be achieved through the positioning of the roller engagement portion 604 relative to the second roller. For example, if a larger amount of compression of the second roller is desired, then the roller engagement portion 604 and/or the roller cleaning assembly 600 may be positioned closer to the core of the second roller. Similarly, if less compression of the second roller is desired, then the roller engagement portion 604 and/or the roller cleaning assembly 600 may be positioned further away from the core of the second roller.

According to some examples, the roller cleaning assembly 600 may have a length corresponding to a length of the second roller. The roller cleaning assembly includes a cutaway portion along its length.

The roller cleaning assembly 600 may, in some examples, include a wall. The wall may form one wall of a channel through which print agent is to flow from the second roller to a print agent capture tray. The print agent tray catches print agent cleaned from the second roller, and may be connected (for example by a pipe or tube) to the print agent reservoir. The print agent may then drain from the print agent capture tray into the print agent reservoir for reuse.

In some examples, the scraper mounting assembly 602 may comprise an adjustment mechanism (not shown) to enable movement of the position of the scraper relative to the scraper mounting assembly. For example, the adjustment mechanism may enable the scraper to be moved closer to the first roller (if, for example, a greater force is to be applied to the first roller) and secured into position. In some examples, the scraper may include a slot through which a screw or bolt is positioned to secure the scraper in position. The screw or bolt may be loosened to enable the scraper to be moved (such that the position of the screw or bolt is moved along the slot of the scraper), then tightened to secure the scraper in a new position (e.g. closer to the first roller).

The roller cleaning assembly 600 may further comprise a scraper support to support a scraper mounted in the scraper mounting assembly. In some examples, the scraper support comprises a protrusion extending from the roller cleaning assembly 600, upon which the scraper rests. In some examples, multiple scraper supports may be provided along the length of the scraper, from the proximal end 124*a* to the distal end 124*b*. In one example, the roller cleaning assembly 600 includes a first scraper support at or near to the proximal end 124*a* of the scraper (e.g. the wiper 124), a second scraper support at or near to the distal end 124*b* of the scraper, and a third scraper support between the first and second supports. The scraper support may be shaped to have a point at the area of contact with a scraper.

The present disclosure is described with reference to flow charts and/or block diagrams of the method, devices and systems according to examples of the present disclosure. Although the flow diagrams described above show a specific order of execution, the order of execution may differ from that which is depicted. Blocks described in relation to one flow chart may be combined with those of another flow chart.

While the method, apparatus and related aspects have been described with reference to certain examples, various modifications, changes, omissions, and substitutions can be made without departing from the spirit of the present disclosure. It is intended, therefore, that the method, apparatus and related aspects be limited only by the scope of the following claims and their equivalents. It should be noted that the above-mentioned examples illustrate rather than limit what is described herein, and that those skilled in the art will be able to design many alternative implementations without departing from the scope of the appended claims.

Features described in relation to one example may be combined with features of another example.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. A print agent application assembly, comprising:

a first roller to remove print agent from a surface of a print agent transfer roller;

a second roller having an absorbent element to engage the first roller as the second roller rotates relative to the first roller, the absorbent element to absorb print agent from the first roller; and a wiper assembly comprising:

a wiper element to scrape print agent from the surface of the first roller as the first roller rotates, and an engagement element to engage with and compress a portion of the absorbent element of the second roller as the second roller rotates relative to the wiper assembly, wherein the engagement element comprises a protrusion extending from the wiper assembly.

2. A print agent application assembly according to claim 1, wherein the wiper assembly has a length corresponding to a length of the absorbent element of the second roller; and wherein the wiper assembly includes a cutaway portion along the length of the wiper assembly.

3. A print agent application assembly according to claim 1, wherein the first roller comprises a cleaner roller, a portion of the cleaner roller being electrically-charged so as to attract electrically-charged print agent from the print agent transfer roller.

4. A print agent application assembly according to claim 1, wherein the wiper assembly includes a wall; and wherein the wall forms one wall of a channel through which print agent is to flow from the second roller to a print agent capture tray.

5. A method comprising:

mounting a first roller and a second roller in a print agent application assembly housing;

mounting a roller cleaning assembly in the print agent application assembly housing, such that a portion of the cleaning assembly engages and compresses a portion of the second roller; and mounting a wiper blade to the roller cleaning assembly such that the wiper blade engages the first roller, thereby to wipe print agent from the first roller as it rotates relative to the wiper blade, wherein the portion of the cleaning assembly that engages and compresses a portion of the second roller comprises a protrusion extending from, or a corner portion of, the roller cleaning assembly.

6. A method according to claim 5, further comprising:

mounting the print agent application assembly housing in a print apparatus.

7. A method according to claim 5, wherein the roller cleaning assembly comprises a single extruded element.

8. A method according to claim 5, wherein the roller cleaning assembly is mounted such that the portion of the second roller is compressed by between 1 millimetre and 3 millimetres.

9. A roller cleaning assembly comprising:

a scraper mounting assembly to enable a scraper to be mounted to the roller cleaning assembly in such a way that the scraper can scrape print agent from a surface of a first roller; and a roller engagement portion to engage and compress a portion of a second roller as the second roller rotates relative to the roller cleaning assembly, wherein the roller engagement portion comprises a portion of the scraper mounting assembly.

10. A roller cleaning assembly according to claim 9, wherein the roller engagement portion is to compress the portion of the second roller by between 1 millimetre and 3 millimetres.

11. A roller cleaning assembly according to claim 9, wherein the roller cleaning assembly has a length corresponding to a length of the second roller; and wherein the roller cleaning assembly includes a cutaway portion along its length.

12. A roller cleaning assembly according to claim 9, wherein the roller cleaning assembly includes a wall; and wherein the wall forms one wall of a channel through which print agent is to flow from the second roller to a print agent capture tray.

13. A roller cleaning assembly according to claim 9, further comprising a scraper support to support a scraper mounted in the scraper mounting assembly.

* * * * *